United States Patent [19]

Barnard et al.

[11] 4,009,595

[45] Mar. 1, 1977

[54] ICE MAKER COMPONENT MOUNTING MEANS

[75] Inventors: Walter C. Barnard, White Bear Lake, Minn.; Kenneth J. Dahlstrom, St. Croix Falls, Wis.

[73] Assignee: Whirlpool Corporation, Benton Harbor, Mich.

[22] Filed: Feb. 6, 1976

[21] Appl. No.: 655,705

[52] U.S. Cl. ..... 62/300; 62/348

[51] Int. Cl.[2] ..... F25C 1/12

[58] Field of Search ..... 62/347, 348, 74, 300

[56] References Cited

UNITED STATES PATENTS

| | | | |
|---|---|---|---|
| 2,682,155 | 6/1954 | Ayres et al. | 62/3 |
| 2,995,905 | 8/1961 | Ayres et al. | 62/344 |
| 3,164,972 | 1/1965 | Swanson | 62/320 |
| 3,230,736 | 1/1966 | Swanson | 62/515 |

*Primary Examiner*—William E. Wayner
*Assistant Examiner*—William E. Tapolcai, Jr.
*Attorney, Agent, or Firm*—Wegner, Stellman, McCord, Wiles & Wood

[57] ABSTRACT

A slab-type ice maker having a cabinet provided with an inner liner, an ice slab-forming evaporator structure, a slab-cutting grid structure, and a water pan structure. Improved structure is provided for mounting the evaporator, cutting grid, and water pan structures in the cabinet.

28 Claims, 7 Drawing Figures

Fig. 1.
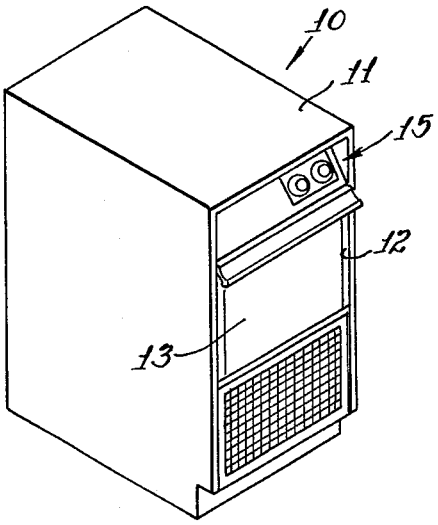
Fig. 2.
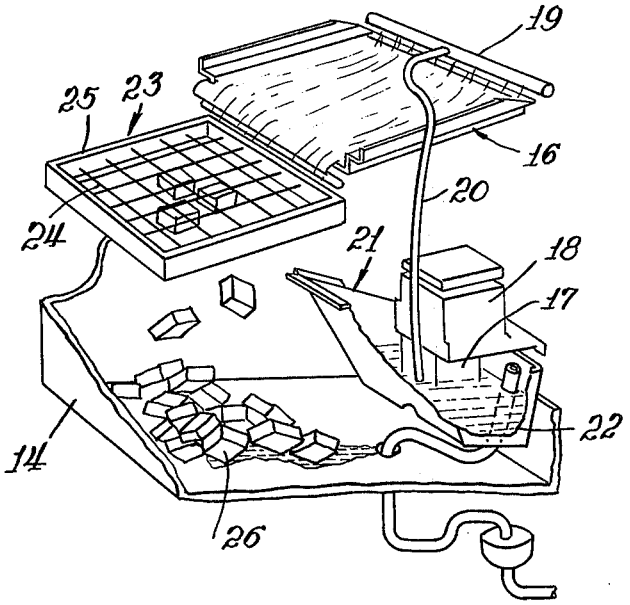
Fig. 4.
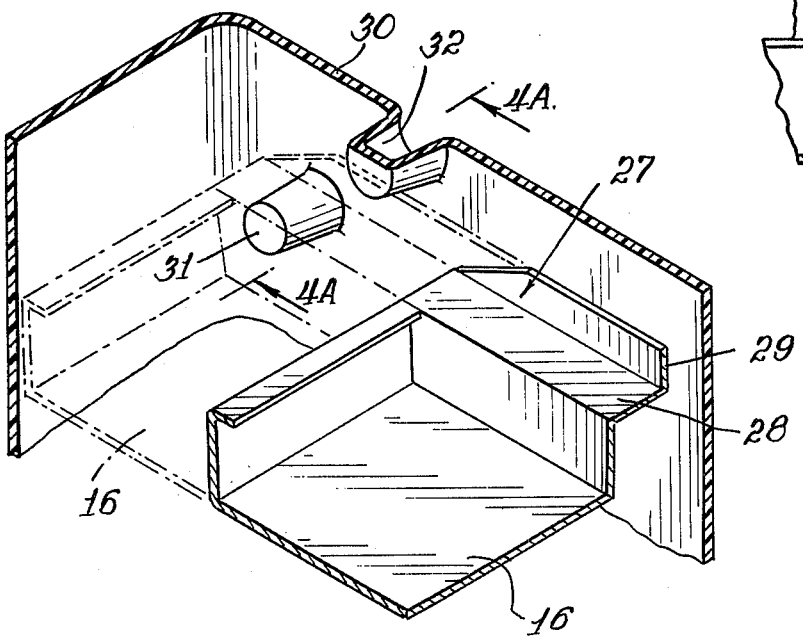
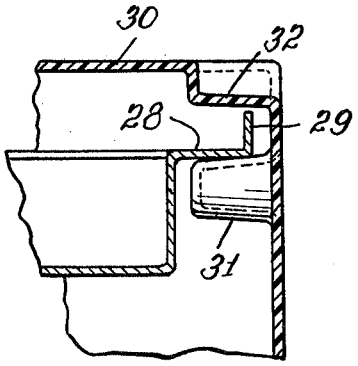
Fig. 4A.

35
33
34
37
36
30
38
46a
42
45
44
25
46
41
43
24

30
25
51
47
53
58
54
48
49
52
56
50
57
55

ICE MAKER COMPONENT MOUNTING MEANS

BACKGROUND OF THE INVENTION

1. Field of the Invention

This invention relates to ice makers, and in particular to slab-type ice makers.

2. Description of the Prior Art

In the U.S. Pat. No. 2,682,155 of Russell W. Ayres et al., owned by the assignee hereof, an ice cube making apparatus is disclosed wherein the ice is formed as a slab of clear ice sufficient in size to form a number of ice cubes. When a slab of the desired thickness is produced on an evaporator portion of the ice maker, the freezing operation is discontinued and the support on which the ice slab is formed is heated to disengage the slab of ice and cause it to move downwardly onto a grid of electrically heated wires which slowly melt through the ice separating the slab into individual cubes.

To form the ice on the evaporator plate, water is recirculated over the plate by means of a pump, the water flowing downwardly from the plate being collected in a water pan for return to an upper end of the evaporator plate by the action of the pump.

The ice maker is installed in an insulated cabinet which conventionally is provided with a liner defining the inner wall surface thereof. In the Ayers et al patent, the water tank is supported on a shelf and other portions of the apparatus are secured to the cabinet by mounting clips and the like.

In the subsequent Russell W. Ayres et al. U.S. Pat. No. 2,995,905, another form of such ice cube forming machine is disclosed having a downwardly extending drain 89 for delivering the returned water from the evaporator to the water pan. Here again, the water pan is carried on a shelf portion of the cabinet.

In Donald F. Swanson U.S. Pat. No. 3,164,972, owned by the assignee hereof, a mounting for the ice maker cutting grid is disclosed comprising a plurality of mounting clips including resilient blocks.

In U.S. Pat. No. 3,230,736 of Donald F. Swanson, owned by the assignee hereof, a plate type evaporator for ice slabs is shown wherein a trough is provided at the lower end of the evaporator for delivering the water through a drain tube to a subjacent sump water pan.

SUMMARY OF THE INVENTION

The present invention comprehends an improved slab-type ice maker structure wherein the slab-forming evaporator means, the slab-cutting grid means, and the water pan are mounted within the cabinet of the ice maker by new and improved mounting means.

In broad aspect, the invention comprehends improved means for mounting the ice maker components to the liner of the cabinet. The mounting means is extremely simple and economical of manufacture, and further facilitates maintenance and servicing of the ice maker.

In the illustrated embodiment, first and second bosses are formed on the liner for supporting rear portions of the evaporator. A third boss is formed on the liner on the opposite sidewalls thereof for receiving a fastening means adapted to mount a front portion of the evaporator to the liner.

The water pan may be mounted to the liner by means of a flange on the rear wall of the liner for suporting a rear portion of the pan.

Second fastening means may be provided for mounting a front portion of the water pan to bracket means attached to the evaporator for supporting the front portion of the water pan subjacent the evaporator.

The cutting grid may be provided with a notched frame adapted to engage tab means carried by the evaporator for supporting a rear portion of the cutting grid assembly adjacent the evaporator. Another boss may be provided in the liner on the opposite sidewalls thereof for receiving a third fastening means for mounting the front portion of the cutting grid.

More specifically, the cutting grid may be provided with a panel to be secured removably to the fourth boss means.

The rear evaporator support means may comprise a pair of spaced bosses on the liner with a portion of the evaporator slidably received therebetween.

The fastening means may include a support plate with means for securing the support plate to the evaporator, and means for removably securing the support plate to the liner.

The water pan may be secured to the liner by the means fastening the support plate to the liner.

The rear portion of the cutting grid means may be mounted to the support plate by removable securing means.

BRIEF DESCRIPTION OF THE DRAWING

Other features and advantages of the invention will be apparent from the following description taken in connection with the accompanying drawing wherein:

FIG. 1 is a perspective view of an ice maker provided with component mounting means embodying the invention;

FIG. 2 is a fragmentary perspective schematic view of the slab ice maker assembly;

FIG. 4 is a fragmentary perspective view of a portion of the evaporator mounting means;

FIG. **4*a* is a fragmentary vertical section taken substantially along the line 4*a*—4*a* of FIG. 4;**

Figure 5:
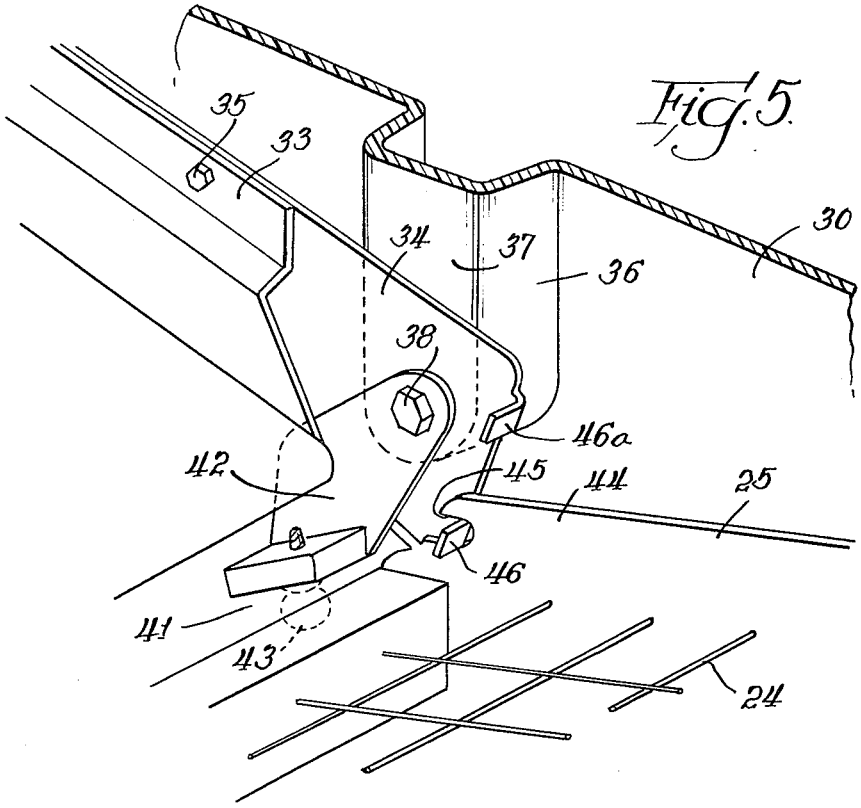
Figure 6:
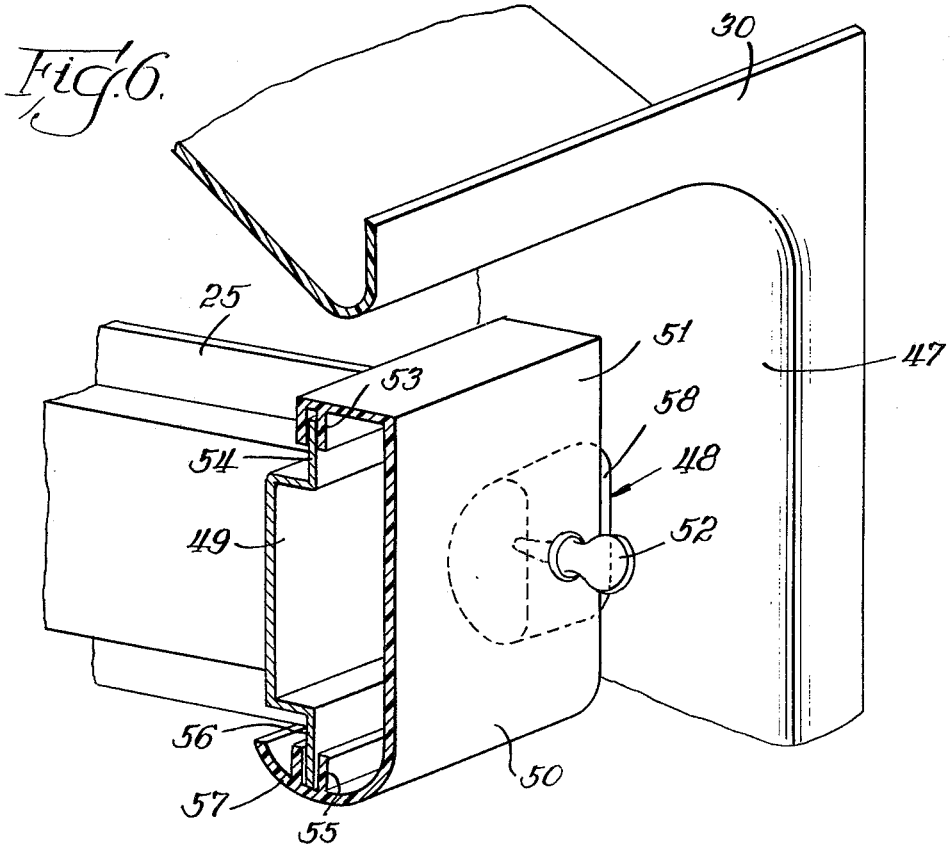

FIG. 5 is a fragmentary perspective view of another portion of the component mounting means; and FIG. 6 is a fragmentary perspective view of still another portion of the component mounting means.

DESCRIPTION OF THE PREFERRED EMBODIMENT

In the exemplary embodiment of the invention as disclosed in the drawing, a slab-type ice maker generally designated 10 is shown to comprise a cabinet 11 having a front opening 12 selectively closed by a door 13 for providing controlled access to an ice cube collecting bin 14. The cabinet may be further provided with conventional control knobs 15 for manually adjusting the operation of the ice maker.

Referring now to FIG. 2, the ice-maker comprises a slab-type ice maker having a refrigerated plate-type evaporator 16 which is adapted to be refrigerated by a conventional means as is well known to those skilled in the art. Water is circulated over the evaporator plate by means of a pump 17 driven by a suitable electrical motor 18 connected to a distributor 19 by means of a conduit 20. After flowing over the refrigerated plate, the water is returned to a subjacent water pan 21 having a sump portion 22 receiving the pump 17 for recirculation of the water to the distributor 19.

During normal operation of the ice maker, the flow of the water over the refrigerated evaporator plate slowly builds up a slab of ice on the upper surfaces of the plate. When the slab reaches a predetermined thickness, as may be determined by conventional control means well known to those skilled in the art, the flow of water is terminated and the evaporator plate is heated so as to release the slab from the plate. The plate is inclined downwardly toward a cutting grid generally designated 23 so that upon release of the slab from the evaporator plate, the slab falls onto a plurality of heated electric wires 24 forming a grid within a box frame 25. The heated wires cut through the ice slab so as to cause the slab to be formed into a plurality of cubes 26 which fall through the cutting grid means into the subjecent ice cube collecting bin 14.

The present invention is concerned with an improved means for mounting the evaporator 16, the cutting grid 23, and the water pan 21 in the cabinet 11. More specifically, the mounting means of the present invention is illustrated in FIGS. 4–6. Referring now more specifically to FIGS. 4 and 4*a*, the right rear corner 27 of evaporator tray 16 defines a turned flange having a horizontal portion 28 and a distal upright portion 29. The liner 30 of the cabinet 11 is provided with a rear boss 31 and a forward upper boss 32. As shown in dotted lines in FIG. 4 and in section in FIG. 4*a*, the flange portion 28 rests on the boss 31 and the upright flange portion 29 underlies the boss 32 to retain the rear portion of the evaporator tray 16 removably mounted to the cabinet.

A similar reverse arrangement of bosses and flanges may be provided at the left rear corner of the evaporator for supporting the opposite side of the evaporator at the rear of the cabinet.

Referring now to the FIG. 5, the front portion 33 of the evaporator plate 16 is provided with a rail 34 which is secured thereto by suitable means such as screws 35. Liner 30 is provided with a boss 36 having an inner surface 37 to which the rail 34 is secured by a suitable screw 38. A similar arrangement is provided at the opposite side of the evaporator plate front portion 33 to mount that side of the opposite portion of the cabinet liner 30.

Figure 3:
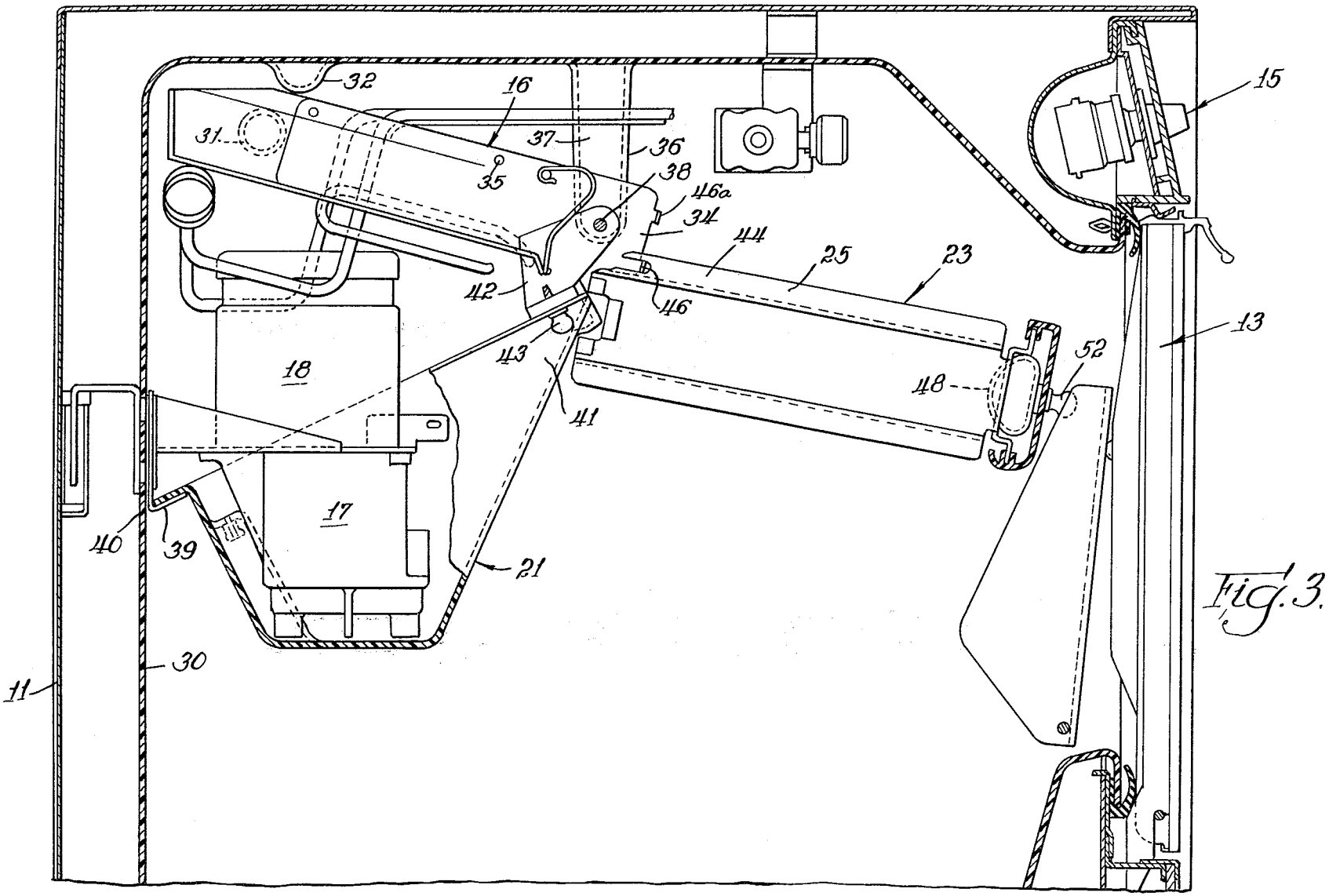
FIG. 3 is a fragmentary vertical section showing the ice maker components mounted in the cabinet.

Water pan 21, as shown in FIG. 3, includes a rear portion 39 removably supported on a flange 40 carried by liner 30. A front portion 41 of the water pan is secured to a support 42 by means of a thumb screw 43. Support 42, in turn, is secured to the liner boss 36 by the screw 38, as best seen in FIG. 5.

Support 42 may comprise a molded synthetic resin element. A similar support means for the front portion of the water pan may be provided at the opposite side of the cabinet.

As indicated above, the cutting grid includes a frame 25. As shown in FIGS. 3 and 5, a rear side portion 44 of the frame may be provided with a rearwardly opening notch 45. Mounting rail 34 may be provided with an inturned tab 46 adapted to be received in the notch 45 when the cutting grid is installed in the cabinet with rear portion 44 forwardly subjacent the front portion of the evaporator. A similar notch and tab means may be provided at the opposite side of the cutting grid. As seen in FIG. 5, the rail 34 may have a second tab 46*a* disposed so as to be in position to receive the opposite notch 45 with the opposite rail being installed in an inverted position relative to the showing of FIG. 5.

The liner 30 is provided at a front portion 47 thereof rearwardly adjacent door 13 with a boss 48. The front portion 49 of the cutting grid frame 25 is provided with a mounting panel 50 which defines a decorative trim at the front of the cutting grid and which further defines a connecting portion 51 adapted to be secured to boss 48 by suitable thumb screw 52. A similar mounting means for the opposite side of the front portion of the cutting grid may be provided with the panel 50 extending fully between the liner portions 47. As best seen in FIG. 6, panel 51 may comprise an extrusion having a downturned groove portion 53 receiving an upturned flange 54 on the cutting grid 44, and an upwardly opening groove portion 55 receiving a downturned flange 56 of the cutting grid portion 49.

The lower portion 57 of panel 50 may define a drip ledge for channeling water from the cutting grid to the opposite sides of the cutting grid. As can be seen in FIG. 6, the rear of the panel 50 is open so as to pass freely over the liner boss 48 to permit the panel portion 51 to be secured to the front face 58 of the boss 48 by the thumb screw 52. Thus, it may be seen that the improved mounting means for the ice maker components provides a facilitated installation and facilitated maintenance and servicing of the ice maker components. The cutting grid means may be readily removed by removal of the thumb screws 52 and withdrawal of the rear portion of the grid cutting means from the tabs 46 without disturbing the mounting of the other components. The evaporator may be removed by removal of the screws 38.

The water pan may be removed from the assembly by removal of the thumb screws 43 and the disengagement of the rear portion of the water pan from the mounting at the rear portion of the water pan.

The mounting of the components is effected with a minimum of fastening devices and with major portions of the mounting means being defined by integrally molded portions of the liner itself. The use of the thumb screws 43 and 52 provides further facilitated maintenance and servicing by eliminating the need for tools in the installation and removal of components of the ice slab making apparatus.

The foregoing disclosure of specific embodiments is illustrative of the broad inventive concepts comprehended by the invention.

Having described the invention, the embodiments of the invention in which an exclusive property or privilege is claimed are defined as follows:

1. In a slab-type ice maker having a cabinet provided with an inner liner, a slab-forming evaporator means, a slab-cutting grid means, and a water pan, improved means for mounting said evaporator means, cutting grid means, and water pan in said cabinet comprising:

first support means formed in said liner for supporting a first portion of said evaporator means on said liner;

second support means formed in said liner for mounting a second portion of said evaporator means on said liner;

third support for supporting a first portion of said water pan on said liner;

fourth support means for mounting a second portion of said water pan on said second support means;

fifth support means for supporting a first portion of said cutting grid means on said evaporator means; and sixth support means formed in said liner for mounting a second portion of said cutting grid means on said liner.

2. The slab-type ice maker structure of claim 1 wherein said first portion of said evaporator comprises a support portion on said evaporator removably engageable with said first support means.

3. The slab-type ice maker structure of claim 1 wherein said first support means comprises a pair of spaced supports formed in said liner and said first portion of said evaporator means is removably slidably received between said supports.

4. The slab-type ice maker structure of claim 1 wherein said first support means comprises a pair of spaced bosses formed in said liner and said first portion of said evaporator means is removably slidably received between said bosses.

5. The slab-type ice maker structure of claim 1 wherein fastening means threadedly removably secures said evaporator means to said second support means.

6. The slab-type ice maker structure of claim 1 wherein said evaporator means includes a support plate, means securing said support plate to said evaporator second portion, and fastening means removably secures said support plate to said second support means.

7. The slab-type ice maker structure of claim 1 wherein fastening means threadedly removably secures said evaporator means to said second support means and said fourth support means includes means secured to said second support means by said fastening means.

8. The slab-type ice maker structure of claim 1 wherein fastening means threadedly removably secures said evaporator means to said second support means and said fourth support means includes a mounting plate removably secured to said second support means by said fastening means and threaded securing means removably secures said second portion of the water pan to said mounting plate.

9. The slab-type ice maker structure of claim 1 wherein said evaporator means includes a support plate, means securing said support plate to said evaporator second portion, and fastening means removably secures said support plate to said second support means, said fifth support means comprising means of said support plate removably carrying said first portion of the cutting grid means on said support plate.

10. The slab-type ice maker structure of claim 1 wherein said sixth support means comprises support bosses formed integrally in said liner and said second portion of said cutting grid comprises means removably engageable with said sixth support means.

11. The slab-type ice maker structure of claim 1 wherein said sixth support means comprises support bosses formed integrally in said liner and said second portion of said cutting grid means includes a mounting panel and fastening means removably securing the mounting panel to said sixth support means.

12. In a slab-type ice maker having a cabinet provided with an inner liner, a slab-forming evaporator means, and a slab-cutting grid means, improved means for mounting said evaporator means and cutting grid means in said cabinet comprising:

first support means formed in said liner for supporting a first portion of said evaporator means on said liner;

second support means formed in said liner receiving fasteners for mounting a second portion of said evaporator means on said liner;

third support means for supporting a rear portion of said cutting grid means on said evaporator means; and fourth support means formed in said liner receiving fastener means for mounting a front portion of said cutting grid means on said liner.

13. The slab-type ice maker structure of claim 12 wherein said first portion of said evaporator comprises support portions on said evaporator removably engageable with said first support means.

14. The slab-type ice maker structure of claim 12 wherein said first support means comprises a pair of spaced supports formed in said liner and said first portion of said evaporator means is removably slidably received between said supports.

15. The slab-type ice maker structure of claim 12 wherein said first support means comprises a pair of spaced bosses formed in said liner and said first portion of said evaporator means is removably slidably received between said bosses.

16. The slab-type ice maker structure of claim 12 wherein fastening means threadedly removably secures said evaporator means to said second support means.

17. The slab-type ice maker structure of claim 12 wherein said evaporator includes a support plate, means securing said support plate to said evaporator second portion, and fastening means removably securing said support plate to said second support means.

18. The slab-type ice maker structure of claim 12 wherein said evaporator means includes a support plate, means securing said support plate to said evaporator second portion, and fastening means removably securing said support plate to said second support means, said third support means comprising means on said support plate removably carrying said first portion of the cutting grid means on said support plate.

19. The slab-type ice maker structure of claim 12 wherein said fourth support means comprises support bosses formed integrally in said liner and said front portion of said cutting grid means includes a support panel on said cutting grid means removably engageable with said fourth support means.

20. The slab-type ice maker structure of claim 12 wherein said fourth support means comprises support bosses formed integrally in said liner and said front portion of said cutting grids includes a support panel on said cutting grid means removably engageable with said fourth support means and fastening means removably secures said panel to said fourth support means.

21. In a slab-type ice maker having a cabinet provided with an inner liner, a slab-forming evaporator means and a water pan, improved means for mounting said evaporator means and water pan in said cabinet comprising:

first support means formed in said liner for supporting a rear portion of said evaporator means on said liner;

second support means formed in said liner for mounting a front portion of said evaporator means on said liner;

third support means for supporting a rear portion of said water pan on said liner; and fourth support means for supporting a front portion of said water pan on said second support means.

22. The slab-type ice maker structure of claim 21 wherein said rear portion of said evaporator comprises a support portion on said evaporator removably engageable with said liner support portions.

23. The slab-type ice maker structure of claim 21 wherein said first support means comprises a pair of spaced supports formed in said liner and said rear portion of said evaporator is removably slidably received between said supports.

24. The slab-type ice maker structure of claim 21 wherein said first support means comprises a pair of spaced bosses formed in said liner and said rear portion of said evaporator is removably slidably received between said bosses.

25. The slab-type ice maker structure of claim 21 wherein fastening means threadedly removably secures said front portion of said evaporator to said second support means.

26. The slab-type ice maker structure of claim 21 wherein said evaporator means includes a support plate, means securing said support plate to said evaporator front portion, fastening means removably securing said support plate to said second support means, and said fourth support includes means secured to said second support means by said fastening means.

27. The slab-type ice maker structure of claim 21 wherein fastening means threadedly removably secures said evaporator front portion to said second support means, and said fourth support means includes a mounting plate removably secured to said liner by said fastening means and threaded securing means removably securing said front portion of the water pan to said mounting plate.

28. In a slab-type ice maker having a liner carried in a cabinet, an improved mounting arrangement for the evaporator means, the cutting grid means and water pan components of said ice maker comprising:

first and second bosses formed in said liner on opposite sidewalls thereof for directly supporting opposite sides of evaporator means adjacent a first end thereof;

a third boss formed in said liner on said opposite sidewalls thereof for receiving first fastener means for mounting a second opposite end of said evaporator means to said liner;

flange means supported on the rear wall of said liner for supporting a first edge of said water pan;

second fastener means for mounting a second opposite edge of said water pan to bracket means attached to said third boss by said first fastener means for supporting said water pan subjacent said evaporator;

tab means carried by said evaporator means adapted to be received in notches formed in the frame of said cutting grid means for supporting a first end of said cutting grid means adjacent said evaporator; and a fourth boss formed in said liner on said opposite sidewalls thereof for receiving third fastener means for mounting a panel carrying a second opposite end of said cutting grid means to said fourth boss.

* * * * *